US005217745A

United States Patent [19]

Patel

[11] Patent Number: 5,217,745

[45] Date of Patent: Jun. 8, 1993

[54] METHOD AND APPARATUS FOR APPLYING A PROGRAMMABLE PATTERN TO A SUCCESSION OF MOVING OBJECTS

[76] Inventor: Baldev Patel, 2522 Pollard Drive, Mississauga, Ontario, Canada, L5C 3G9

[21] Appl. No.: 687,829

[22] Filed: Apr. 19, 1991

Related U.S. Application Data

[63] Continuation-in-part of Ser. No. 372,688, Jun. 28, 1989, abandoned.

[51] Int. Cl.[5] ..... B05D 5/10; B05D 1/02; B05C 11/10

[52] U.S. Cl. ..... 427/8; 118/669; 118/682; 118/697; 118/703; 118/713; 427/207.1; 427/286

[58] Field of Search ..... 118/669, 682, 697, 324, 118/679, 713, 703, 706; 427/8, 286, 208.2, 208.6, 207.1

[56] References Cited

U.S. PATENT DOCUMENTS 4,357,900 11/1982 Buschor ..... 118/682 X
4,389,971 6/1983 Schmidt ..... 118/682 X

*Primary Examiner*—Evan Lawrence

*Attorney, Agent, or Firm*—Merchant & Gould Smith, Edell, Welter & Schmidt

[57] ABSTRACT

Method and apparatus for applying a programmable pattern to a succession of moving objects, comprising a microprocessor for storing a user defined value representing the length of the pattern, a clock for generating a series of pulses and a photo-eye for detecting the presence of the succession of moving objects. Upon detecting the presence of a first one of the moving objects, a set-up mode gate is enabled for transmitting the clock pulses to a first divider circuit. The first divider circuit divides the number of transmitted clock pulses by the user defined value and in response generates and stores a first count value. Upon detecting the presence of subsequent moving objects, a run mode gate transmits successive predetermined numbers of clock pulses to a second divider circuit. The second divider circuit divides the successive predetermined numbers of clock pulses by a first count value and in response generates successive further count values. A microprocessor compares the successive further count values with the user defined value and in the event the values are equal initiates application of the programmable pattern to the succession of objects, and in the event more than a predetermined number of the successive further count values are not equal to the user defined value the microprocessor re-initiates the setup mode procedure.

18 Claims, 14 Drawing Sheets

METHOD AND APPARATUS FOR APPLYING A PROGRAMMABLE PATTERN TO A SUCCESSION OF MOVING OBJECTS

CROSS-REFERENCE TO RELATED APPLICATION

This is a continuation-in-part of application Ser. No. 372,688, filed on Jun. 28, 1989, now abandoned.

FIELD OF THE INVENTION

This invention relates in general to systems for applying a programmable pattern to articles in an industrial process, and more particularly to a time based programmable pattern generator in which the length of successive objects is detected relative to a free running clock.

BACKGROUND OF THE INVENTION

Programmable pattern generators are well known for applying patterns to articles in an industrial process. For example, U.S. Pat. No. 4,389,971 discloses an apparatus for regulating the application of glue to a defined area of a moving paper board box blank including a sensor for detecting the presence of the leading and trailing edges of a glue application area. A pulse generator provides pulses indicative of the movement of the application area. The sensor initiates a counting action at detection of the leading edge of a glue application area such that after a predetermined number of pulses have been counted by a counter (representative of the fixed distance between the sensor and glue applicator), glue application is initiated. The sensor initiates a second counting action at detection of the trailing edge of the glue application area and the counter stops glue application after the same predetermined number of pulses representative of the sensor glue applicator fixed distance.

Accordingly, this prior art United States patent teaches the general concept of feedback control in a glue application system responsive to leading and trailing edges of an object to which the adhesive is applied. The disadvantage of this system is that the rate of application of glue is dependant upon the detected distance between flaps (i.e. length of glue application area) relative to movement of the conveyor. The result is that in the event the conveyor slows down or speeds up, initiation and termination of glue application is controlled in terms of area instead of rate of application of the adhesive. In other words, in the event the conveyor runs more slowly than usual, a larger amount of adhesive will be applied over the same area.

U.S. Pat. No 4,357,900 discloses an apparatus for automatic spray control of articles carried by a conveyor. A sensor monitors the position of the article and generates signals representative thereof. A second sensor generates additional signals to the control device when a article passes a predetermined point. The control device controls the spraying process responsive to the signals.

As with the aforementioned U.S. Pat. No 4,389,971, the system disclosed in U.S. Pat. No 4,357,900 requires a sensor for detecting motion of the conveyor and producing a clock signal to mark each time the conveyor has moved a predetermined increment along its path. Thus, this latter system suffers from the same disadvantage as the prior art system discussed above in that there is no feedback control of adhesive application responsive to the object length with reference to an absolute time frame. Instead, the latter system controls adhesive application only with respect to relative movement of the conveyor.

SUMMARY OF THE INVENTION

According to the present invention, a method and apparatus is provided for effecting accurate application of a programmable pattern to a succession of moving objects based on an absolute time frame, without any mechanical couplings of encoder, pulse generator with gears or chain sprocket installation to the machine or conveyor, as in the above referenced prior art systems.

The present invention provides for a method and apparatus for applying a programmable pattern to a succession of moving objects, comprising a microprocessor for storing a user defined value representing the length of the pattern, a clock for generating a series of pulses and a photo-eye for detecting the presence of the succession of moving objects. Upon detecting he presence of a first one of the moving objects, a set-up mode gate is enabled for transmitting the clock pulses to a first divider circuit. The first divider circuit divides the number of transmitted clock pulses by the user defined value and in response generates and stores a first count value. Upon detecting the presence of subsequent moving objects, a run mode gate transmits successive predetermined numbers of clock pulses to a second divider circuit. The second divider circuit divides the successive predetermined numbers of clock pulses by a first count value and in response generates successive further count values. A microprocessor compares the successive further count values with the user defined value and in the event the values are equal initiates application of the programmable pattern to the succession of objects, and int eh event more than a predetermined number of the successive further count values are not equal to the user defined value the microprocessor reinitiates the setup mode processor.

BRIEF DESCRIPTION OF THE DRAWINGS

A description of the preferred embodiment will be describe din greater detail below with reference to the following drawings in which.

DETAILED DESCRIPTION OF THE PREFERRED EMBODIMENT

As discussed above, the method and apparatus of the present invention relate to generating a programmable pattern for application to articles or objects in an industrial process. For example, the invention may be used to generate a programmable pattern of glue stitches on packaging machinery or in order to detect the position of an object on a conveyor belt.

Operation and use of the present invention will be described with reference to various examples and to the flow charts in FIGS. 12-14.

Figure 1:
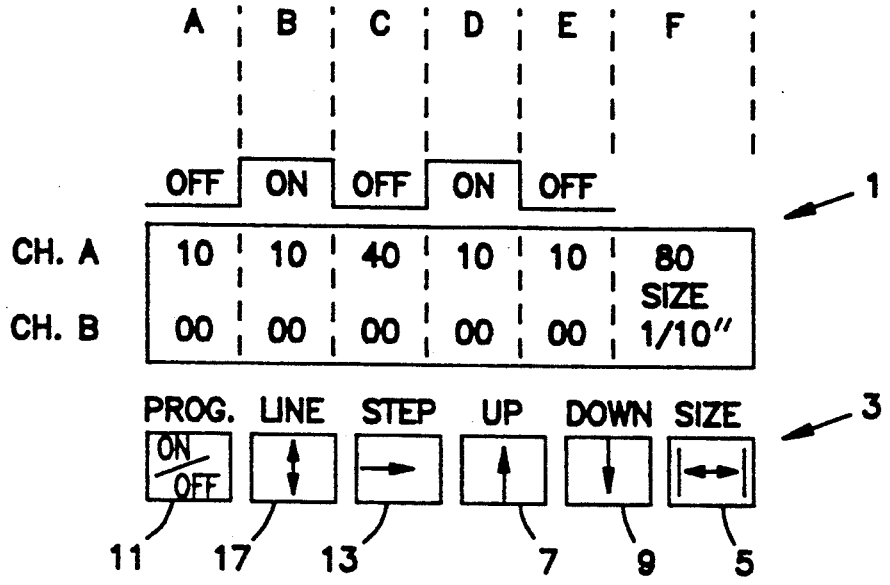
FIG. 1 is a schematic representation of a user input interface and data display portion of the apparatus of the present invention programmed in accordance with a first example.

Turning to FIG. 1, a portion of a front panel of the programmable pattern generator according the present invention is shown comprising a user defined value display unit 1 disposed over a user input keyboard 3. The display unit 1 is divided into six columns labelled A-F and two rows labelled channel A and channel B. Each of the columns A-E represents one of either an ON or OFF state of the programmed pattern while column F represents the length of an object to which the pattern is applied. In particular, columns A, C and E are reserved for programming spaces or gaps in the pattern, whereas columns B and D are used to program active or ON portions of the pattern intermediate the spaces or gaps.

For example, in order to apply a glue pattern on a package which is 8 inches long, starting from the leading edge and leaving a space of 1 inch, followed by a 1 inch of glue bead, leaving a space of 4 inches, followed by a further 1 inch bead of glue and leaving a final space of one inch to the trailing edge of the object, the apparatus is programmed by executing a series of simple steps.

Figure 12:
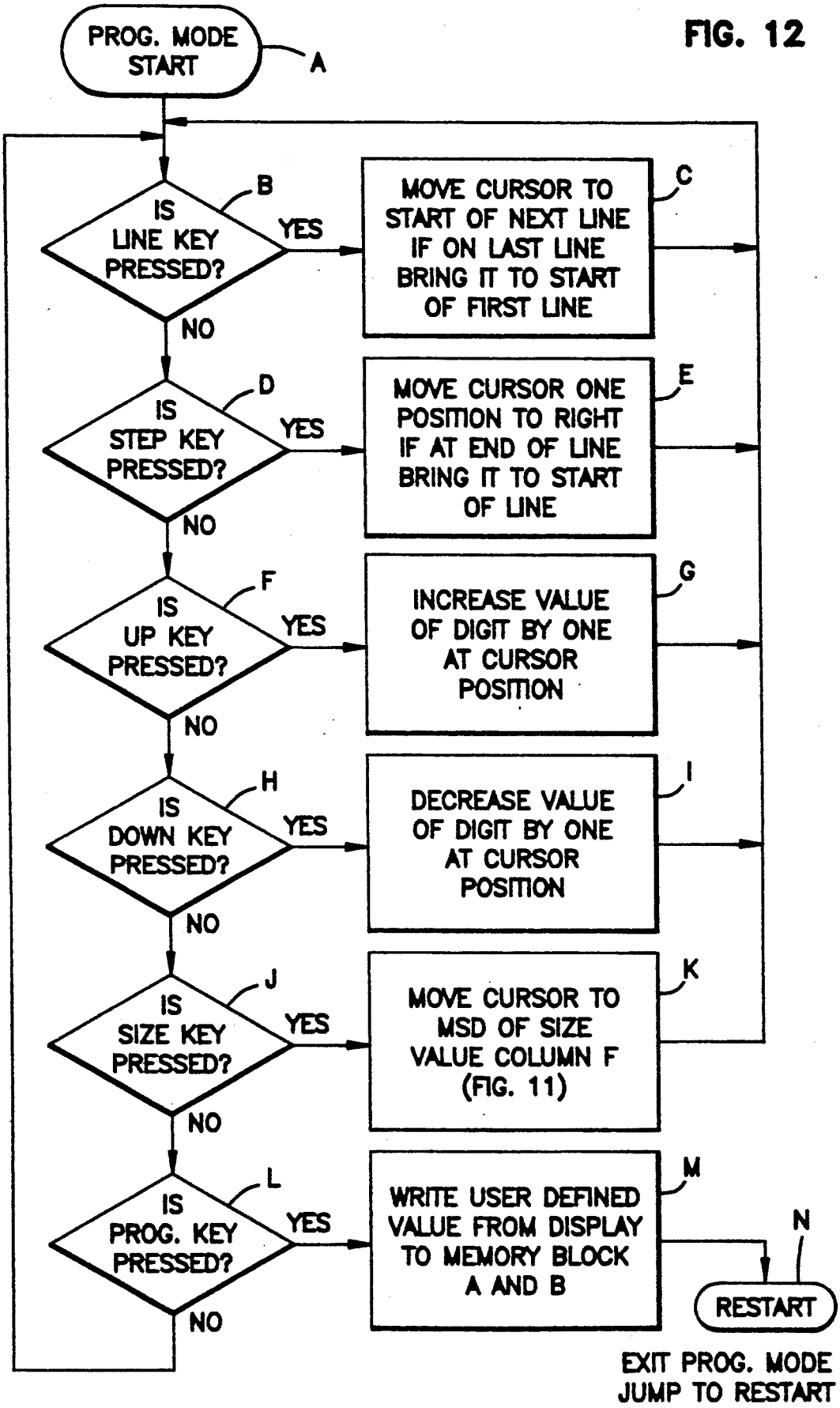
FIG. 12 is a flow diagram of a method for applying a glue pattern on a package compatible with the present invention.

First, the PROG key 11 is depressed once for interrupting an internal microprocessor (FIG. 10) to enter into a programming mode (FIG. 12, Step A). In response to depressing the PROG key 11, a cursor is caused to flash at column A.

Next, the size of the object is entered by depressing the SIZE key 5 for activating column F (FIG. 12, Steps J and K), and thereafter (FIG. 12, Steps F, G, H, I) using UP and DOWN keys 7 and 9 to set a value of 80 units in column F (each unit being one tenth of an inch).

In order to exit the SIZE mode, first the STEP key 13 is depressed, which results in movement of the cursor of display unit 1 to the least significant digit. Upon subsequently depressing the SIZE key 5, the cursor moves to the position of the first digit at column A.

In order to program the first one inch space from the leading edge of the object, keys 7 and 9 are used to set a value of 10 units at column A.

Next, STEP key 13 is used to shift the cursor into column B (FIG. 12, Steps D and E), and keys 7 and 9 are used to enter a value of 10 units at column B.

Then, the STEP key 13 is depressed to move the cursor to column C, and keys 7 and 9 are used to enter a value of 40 units (i.e. 4 inches) at column C.

In a similar manner, keys 7, 9 and 13 are used to enter the respective ON and OFF states at columns D and E as well the values of 10 in each of columns D and E for designating respective one inch patterns.

Once the entire pattern has programmed via appropriate entries into columns A-F, the microprocessor may be caused to exit the program mode and return to normal operation mode by simply re-depressing PROG key 11 (FIG. 12, Steps L, M and N).

Figure 2:
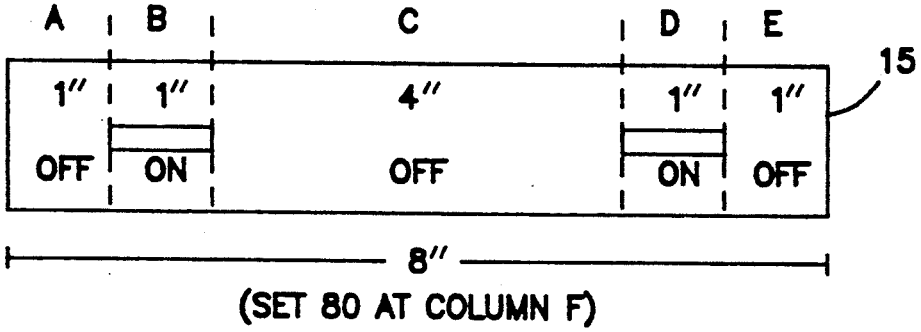
FIG. 2 is a schematic illustration of an object of which a programmable pattern has been applied in accordance with the example referred to in FIG. 1.

FIG. 2 illustrates the actual pattern as applied to a package 15, with dimensions, column designations and ON/OFF designations being shown for correlating the actual pattern applied to the object with the programmed pattern illustrated in FIG. 1.

As discussed above, two independently programmable pattern generating channels are provided. The example discussed with reference to FIG. 1 relates to a pattern programmed into channel A. However, in order to independently program a separate pattern in channel B, LINE key 17 is depressed (FIG. 1).

The unit value of $^1/_{10}''$ in column F can be replaced by $^2/_{10}''$ by depressing SIZE key 5 at the same time as a hardware reset button (not shown). Such a hardware reset button is standard apparatus with conventional microprocessors, and the operation thereof is well known in the art. This results in all units on the display 1 being $^2/_{10}''$, which is useful for programming patterns on large objects. The unit value can be toggled back to $^1/_{10}''$ by depressing the reset button and size value key again.

Also, the values shown on the display 1 can be cleared by simultaneously depressing the reset button and LINE key 17. This can be useful for programming new values for new applications, for correcting errors, etc.

Figure 3:
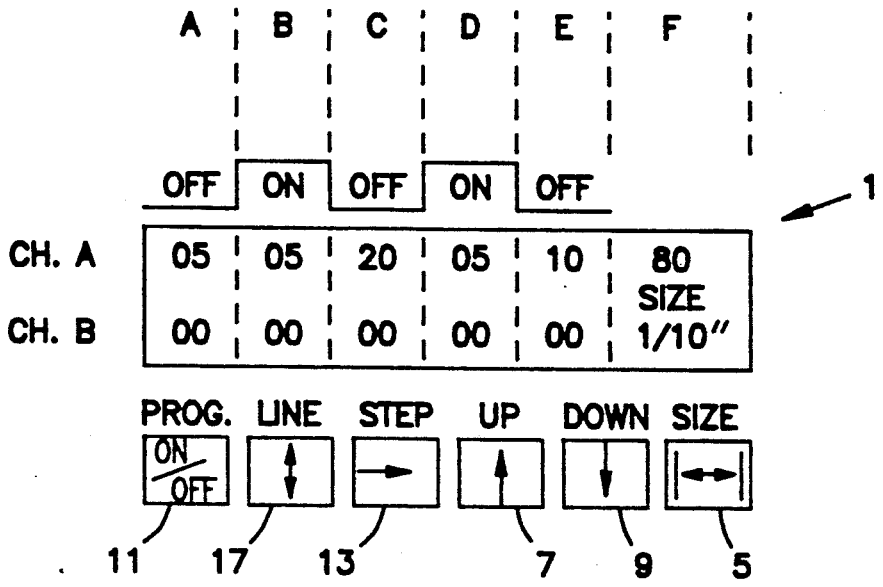
FIG. 3 is a schematic representation of a user input interface and data display portion of the apparatus of the present invention programmed in accordance with a second example.
Figure 4:
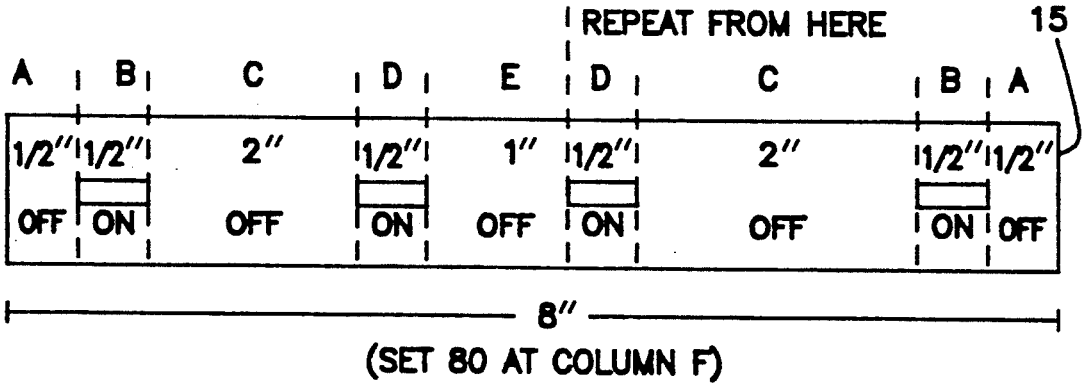
FIG. 4 is a schematic illustration of an object to which a programmable pattern has been applied in accordance with the example referred to in FIG. 3.

According to a second example, the apparatus may be programmed to repeat a programmable sequence, as shown with reference to FIGS. 3 and 4.

As discussed above with reference to FIG. 1, the size of the package may be entered at column F in FIG. 3 (e.g. 80 units equals 8 inches). However, by programming ON and OFF states into columns A-E such that the total programmed length from A to E is less than the programmed size at column F, the pattern will repeat at B after executing the step at column E.

The example of FIGS. 3 and 4 illustrates adjacent OFF and ON patterns of 05 units (i.e. one half inch) at columns A and B, a two inch OFF state at column C, a one half inch ON state at column D and one inch OFF state at column E, resulting in the symmetric repeating pattern shown in FIG. 4.

Figure 5:
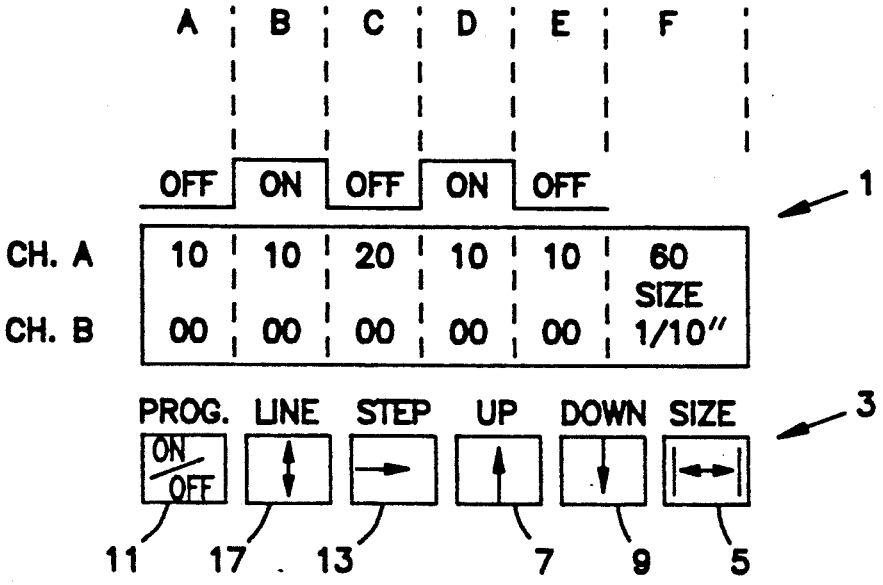
FIG. 5 is a schematic representation of a user input interface and data display portion of the apparatus of the present invention programmed in accordance with a third example.
Figure 6:
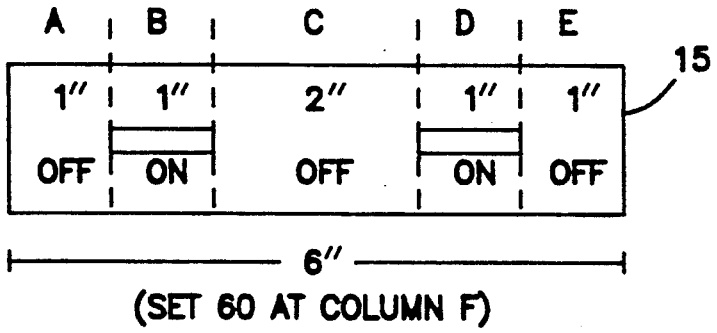
FIG. 6 is a schematic illustration of an object to which a programmable pattern has been applied in accordance with the example referred to in FIG. 5.

A third illustrative example is shown with reference to FIGS. 5 and 6 in which a six inch carton has been selected, represented by the value of 60 units at column F (FIG. 5). A first one inch space is entered by programming an OFF state for 10 units (i.e. $10\times{}^{1}/_{10}''$) at column A; application of a one inch pattern follows by programming an ON state for 10 units column B; a two inch space follows by programming an OFF state for 20 units at column C; a one inch pattern is applied next by programming an ON state for 10 units at column D; and finally a one inch space is provided by programming an OFF state for 10 units at column E. The pattern as applied to an object 15 is shown with reference to FIG. 6.

Figure 7:
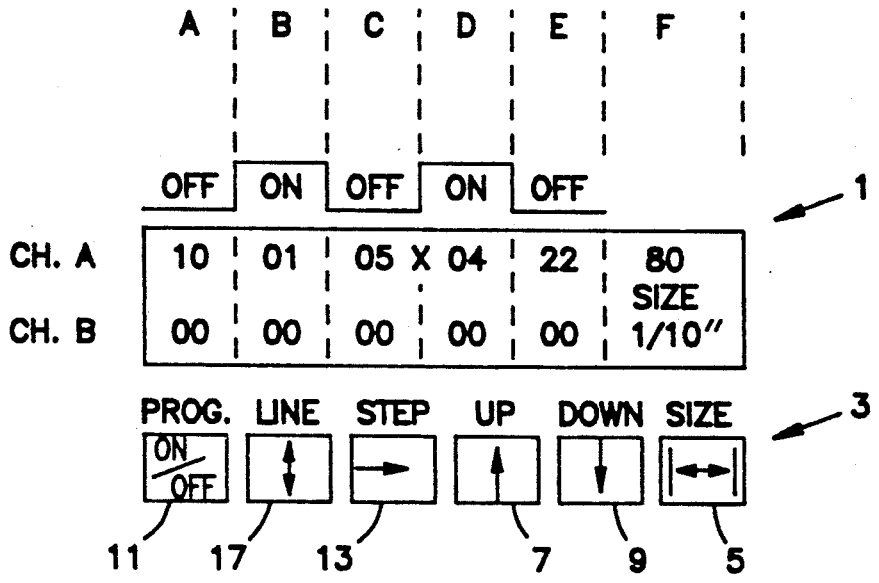
FIG. 7 is a schematic representation of a user input interface and data display portion of the apparatus of the present invention programmed in accordance with a fourth example.
Figure 8:
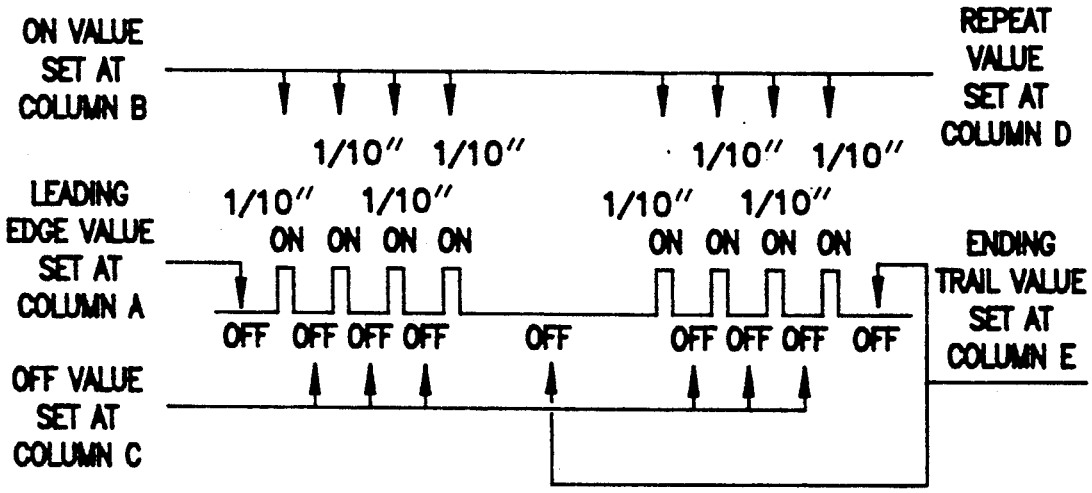
FIG. 8 is a time chart illustrating ON and OFF times and durations in accordance with the example referred to in FIG. 7.
Figure 9:
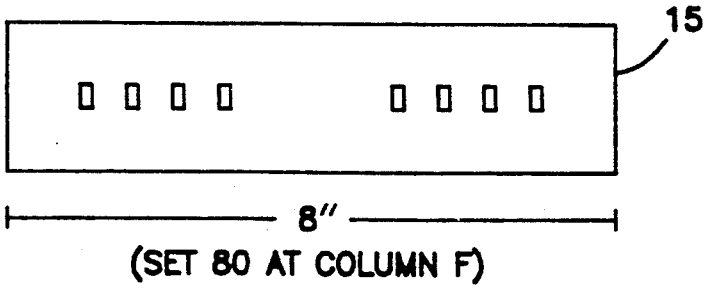
FIG. 9 is a schematic illustration of an object to which a programmable pattern has been applied in accordance with the example referred to in FIG. 7.

An additional feature of the present invention is provided by which adjacent states programmed at columns B and C may be made to repeat a predetermined number of times, as shown in the example of FIGS. 7–9. To enter this mode, the step key 13 is depressed simultaneously with the hardware reset button. In response to entering this mode, the user defined value display unit 1 displays an X between columns C and D for indicating that the states defined by the values entered into columns B and C will be repeated for the number of times indicated at column D.

Thus, for the example shown with reference to FIGS. 7, 8 and 9, a one tenth ON state is in column B followed by a one half inch OFF state in column C, which states are repeated 4 times following an initial one inch space from the leading edge of the object. This pattern is established by programming an OFF state for 10 units at column A, an ON state for 1 unit at column B, an OFF state for 5 units at column C and an ON state for 4 units (i.e. multiplication by 4) at column D. By entering a value of 22 units at column E, the entire pattern is made to repeat as discussed above with reference to the example of FIGS. 3 and 4. This feature of the invention is particularly useful for applying patterns to case flaps (e.g. cases of beer where each flap must have 5 dots of glue, then miss a middle section and repeat the sequence on the second flap). As discussed above, the apparatus may be programmed to give more than one pattern simultaneously by programming the other available channel or channels.

Figure 10:
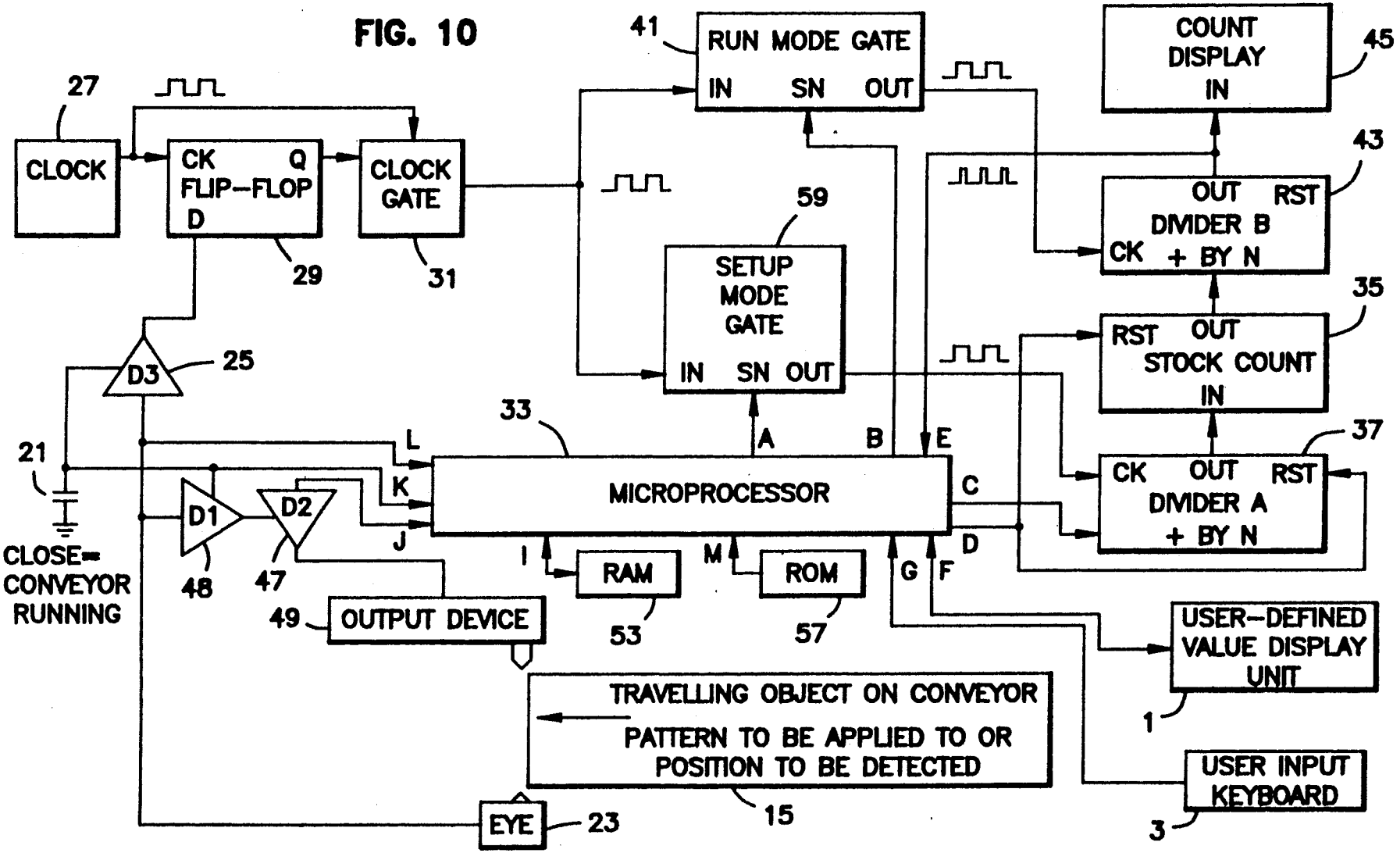
FIG. 10 is a block schematic diagram of a programmable pattern generator in accordance with the preferred embodiment.

Turning now to FIG. 10, a schematic block diagram is shown of a programmable pattern generator in accordance the preferred embodiment of the present invention.

For the following description of operation, an example is chosen in which the user defined object size is 2 inches and columns A–E are programmed as follows:

A=off for 0.5 inches;
B=on for 0.3 inches;
C=off for 0.4 inches;
D=on for 0.3 inches; and
E=off for 0.5 inches.

Figure 11:
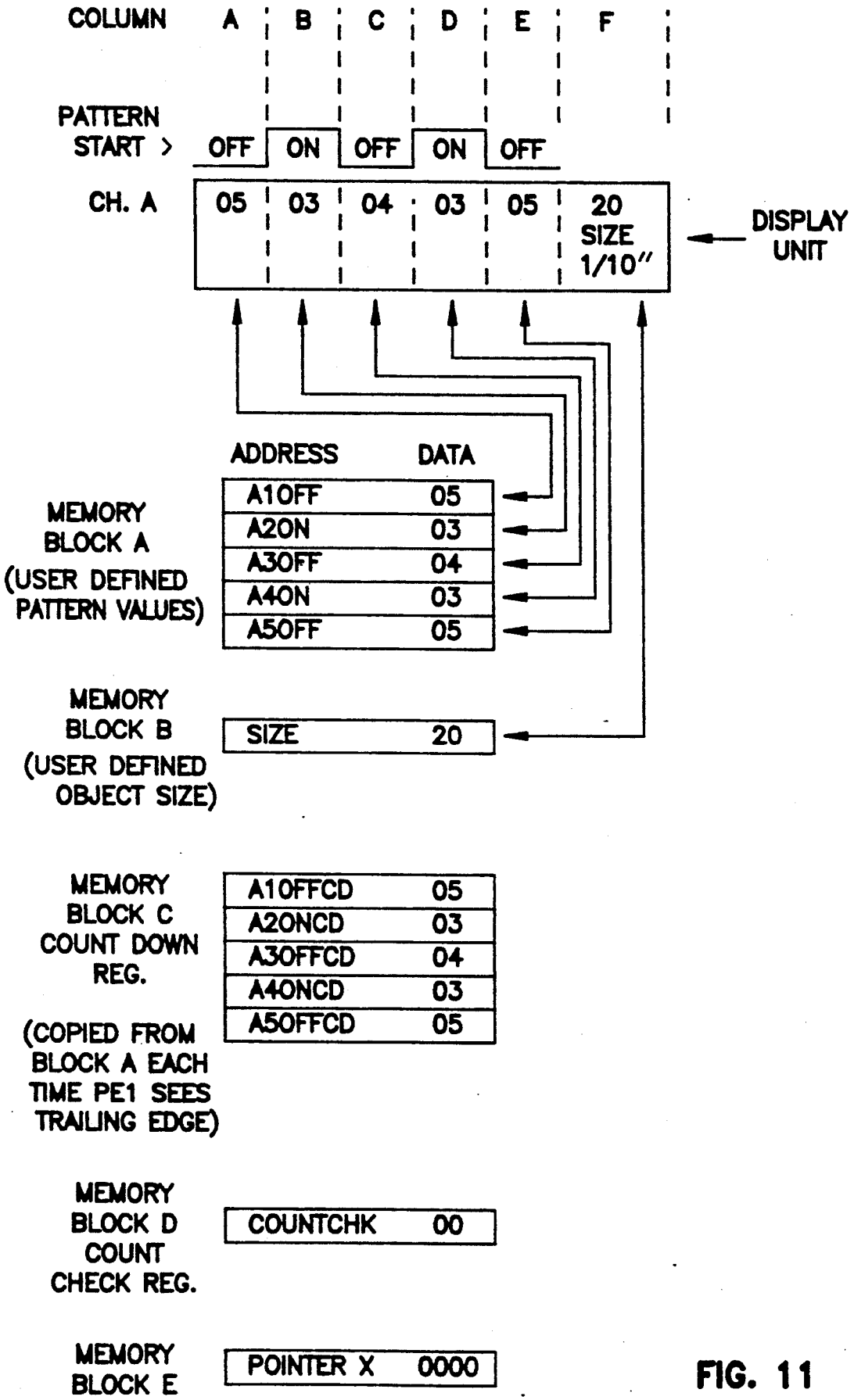
FIG. 11 is a schematic representation of a user input interface, data display portion and memory allocation table of the pattern generator according to the present invention.

The memory allocation and data contents of microprocessor 33 are as shown in FIG. 11. Specifically, memory block A contains the user defined pattern values, memory block B contains the user defined object size, memory block C contains a countdown register which is copied from block A each time the photo eye 23 detects a trailing edge, memory block D contains a count check register value, and memory block E contains a pointer value denoted as "pointer X".

Figure 13A:
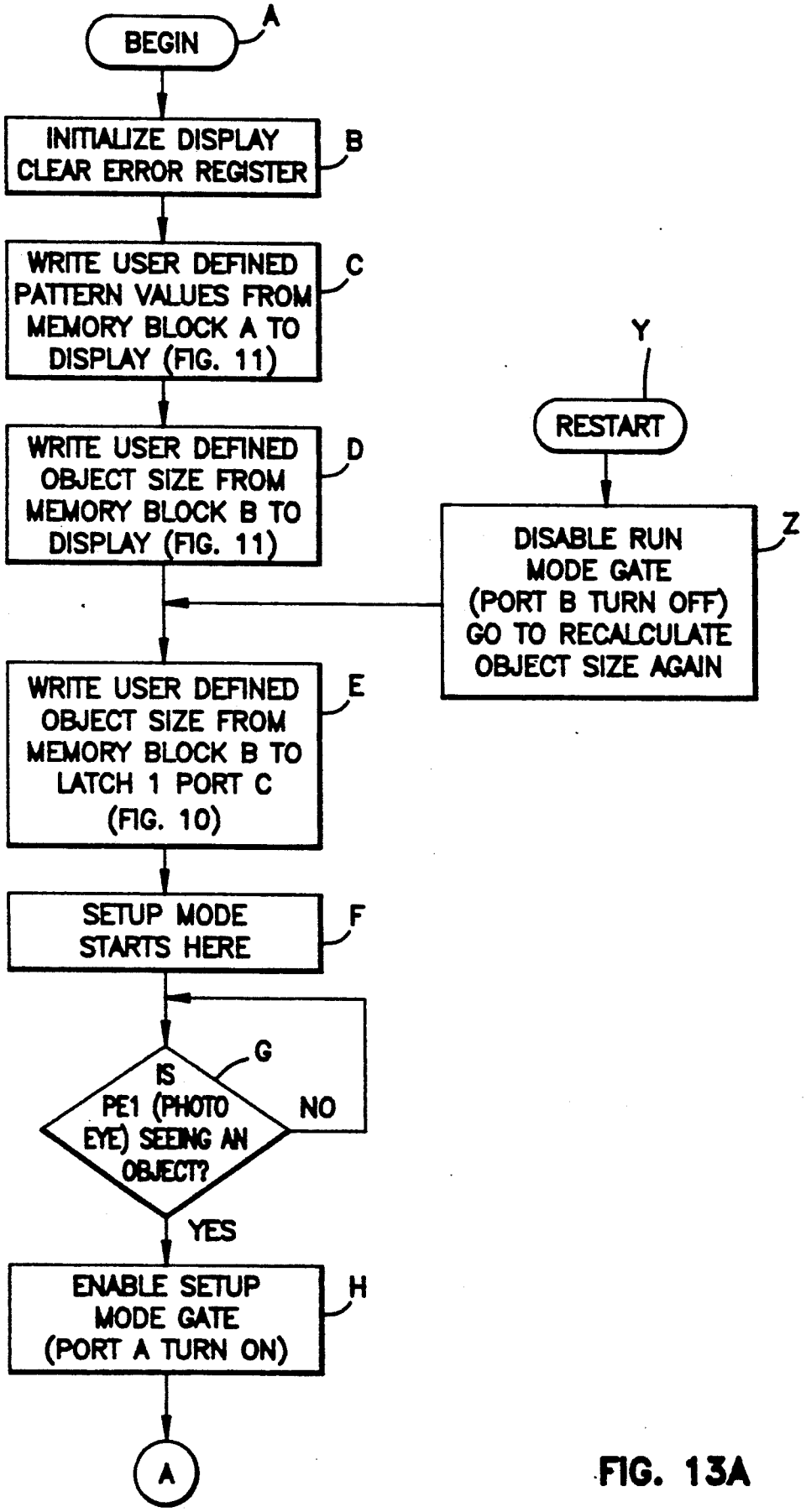
FIGS. 13A and 13B are a flow diagram for a method of operation of a programmable pattern generator compatible with the present invention.

Upon power-up or upon activation of a hard reset of the programmable pattern generator (FIG. 13A, Step A), the microprocessor 33 initializes display unit 1 and clears an internal error register as discussed in greater detail below, (FIG. 13A, Step B).

Next, with reference to FIG. 11, the user defined pattern values are transferred from memory block A to the display unit 1 (FIG. 13A, Step C).

Then, at FIG. 13A, Step D, the user defined object size is written from memory block B to the display unit 1 (FIG. 11).

Next, at FIG. 13A, Step E, the user defined object size is retrieved from memory block B and applied to output port C of microprocessor 33 (FIG. 10).

At FIG. 13A, Step F, the setup mode operation begins.

The programmable pattern generator is enabled in the event that the object conveyor or machine is operating and the presence of an object has been detected. The operating condition of the conveyor or machine is conveyed by a machine enable signal which can be generated responsive to closure of a contact 21. Presence of a travelling object 15 on the conveyor is detected by a photo eye 23 in a well known manner.

A driver 25 is powered responsive to the presence of the aforementioned machine enable signal for transmitting a logic high signal received from photo eye 23 indicating the presence of an object on the conveyor. In other words, driver 25 will generate a logic high output signal only if the conveyor is running and the photo eye 23 has detected the object. If either of these conditions are not true during an operating cycle, all count cycles are frozen and generation of the programmable pattern is disabled, as will be described in greater detail below.

A free running clock 27 generates a series of clock pulses for application to the clock input of a D type flip-flop 29. The clock pulses are also applied to an input of clock gate 31. A Q output of flip-flop 29 is applied to an enable input of the clock gate 31 such that in the event of a logic high signal output from driver 25 applied to the D input of flip-flop 29, clock 31 is enabled via the corresponding logic high output received from Q output of flip-flop 29 for transmitting the series of clock pulses received from clock 27.

Meanwhile, a microprocessor 33 executes a polling routine of port L to determine whether the photo eye 23 has detected an object 15. The microprocessor 33 also clears a count storage circuit 35 and a first divider circuit 37 via reset inputs RST thereof connected to an output port D of the microprocessor 33. Upon detecting the presence an object via polling the port L (FIG. 13A, Step G), the microprocessor 33 generates an enable signal on port A for enabling a set-up mode gate 59 (FIG. 13A, Step H). As discussed above, upon detection of the object 15 via photo eye 23, the clock pulses from clock 27 are transmitted through gate 31. Hence, set-up mode gate 59 effectively transmits the clock pulses received from gate 31 and applies them to a clock input of the first divider circuit 37.

Figure 13B:
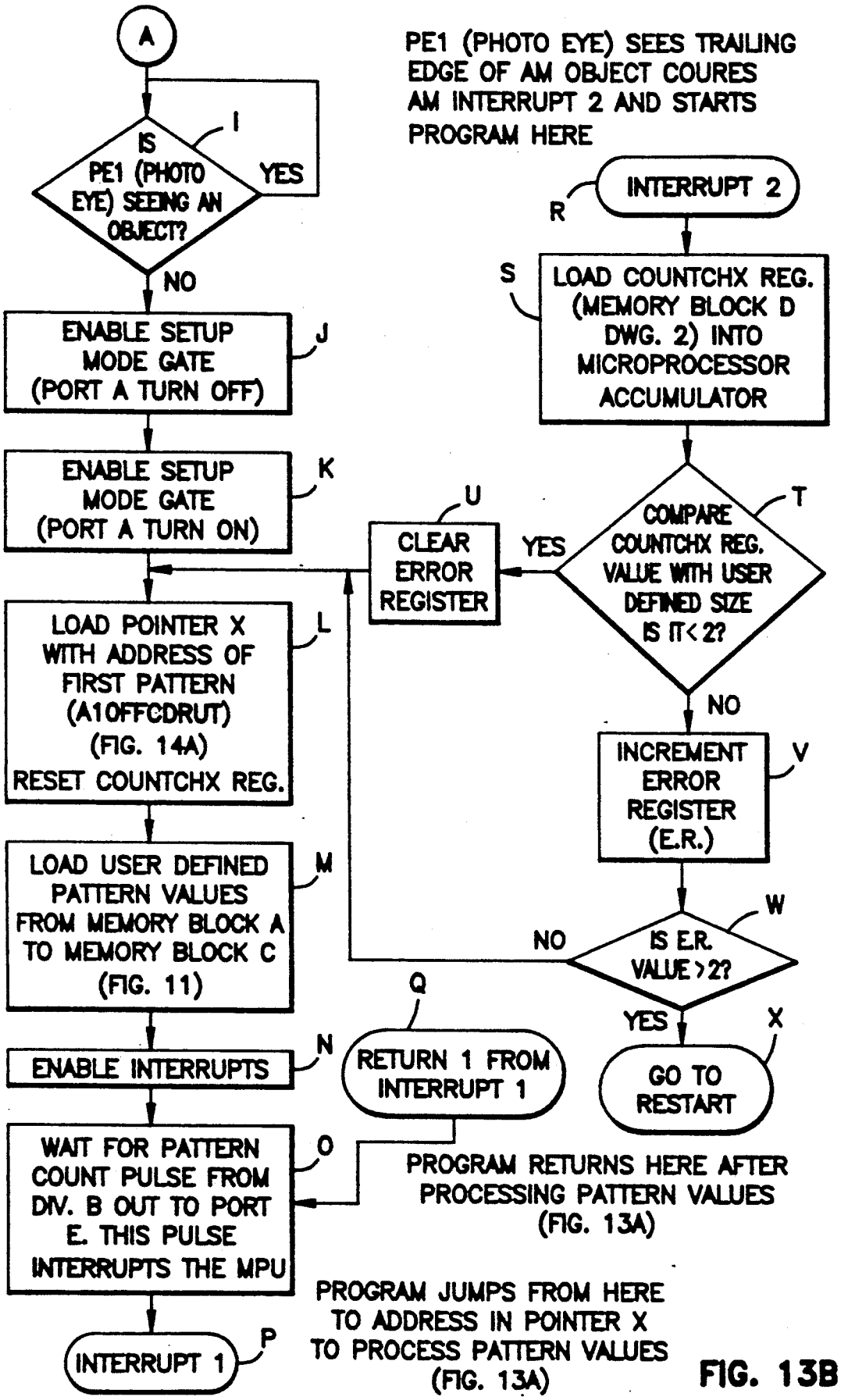

As discussed above with reference to FIGS. 1–9, during programming of the system, user defined object length ON/OFF values are programmed via the user input keyboard 3 and displayed via user defined value display unit 1 connected to ports F and G of the microprocessor 33. The user defined object length value stored at column F is output from port C of microprocessor 33 and applied to a divide-by input of divider circuit 37. Thus, divider circuit 37 divides the received clock pulses by the programmed object size selected by the user and the divided output pulses (denoted as the "Q" factor) from circuit 37 are stored in the block count storage circuit 35. Once the trailing edge of object 15 has passed and cleared the photo eye 23, driver 25 is disabled and the microprocessor 33 detects absence of the object via port L (FIG. 13B). Thus, clock gate 31 closes and microprocessor 33 disables set-up mode gate 59 by generating a logic low signal on port A (FIG. 13B, Step J).

The microprocessor 33 now automatically enables a run mode gate 41 by generating a logic high signal on port B, and waits for the next object to be detected via photo eye 23 (FIG. 13B, Step K).

In the meantime, within microprocessor 33 (FIG. 13B, Step L) the memory location for pointer X is loaded with the address of the first pattern (A1OFFCDRUT), and the user defined pattern values are loaded from memory block A to memory block C at FIG. 13B, Step M (FIG. 11), and microprocessor interrupts are enabled via ports L and E (FIG. 13B, Step N).

Upon detection of the next object (i.e. the conveyor must still be running) driver 25 is again enabled such that the clock pulses from clock 27 are transmitted through run mode gate 41 and applied to a clock input of a second divider circuit 43. The first count value (i.e. the "Q" factor) stored in count storage circuit 35 is applied to the divide-by input of divider circuit 43 such that the incoming pulses from run mode gate 41 are divided by the value stored in the circuit 35, thereby generating the aforementioned pattern count pulses.

Upon receipt of the first pattern count pulse from divider 43 at port E of microprocessor 33, the microprocessor is interrupted (FIG. 13B, Step O) and program flow jumps to the address stored in pointer X for applying the pattern to the object (FIG. 13A, Step B).

Figure 14A:
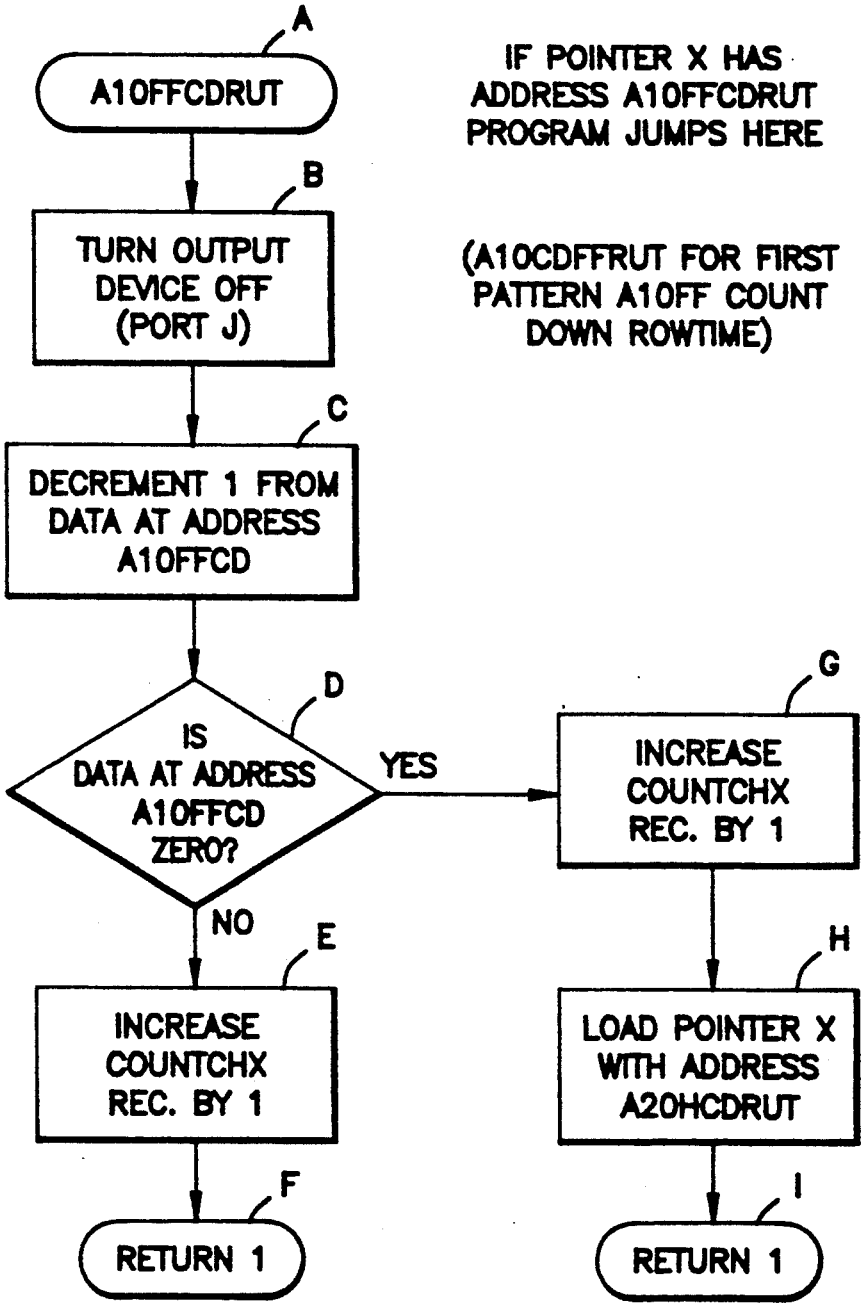
FIGS. 14A, 14B, 14C, 14D and 14E are flow diagrams for different embodiments of a method of handling microprocessor interrupts compatible with the present invention.

Specifically, according to interrupt 1, upon receipt of the first pattern count pulse, microprocessor 33 counts down the first user defined pattern value stored in memory block A at address A1OFF (i.e. in the example shown, the value is 05). Pointer X contains an address A1OFFCDRUT which is location of the first user pattern A1OFF countdown routine (FIG. 14A, Step A). In FIG. 14A, Step B, output device is disabled. Next, at Step C, the A1OFFCD register of memory C is decremented by 1.

At Step D, the data at address A1OFFCD is checked for 0. In the first pass through the interrupt 1 subroutine, the count has been decremented to 4 within register A1OFFCD such that the program exits through decision branch NO at Step D. Next, at Step E, the COUNTCHK register (memory block D) is incremented by 1 in order to keep track of the number of pattern count pulses generated per object passing photo eye 23, as discussed in detail below with reference to interrupt 2.

At FIG. 14A, Step F, program flow returns to FIG. 13B, Step Q.

Upon receipt of the next pattern count pulse from divider 43 applied to port E of microprocessor 33, the microprocessor is again interrupted and re-executes interrupt 1 as discussed above with reference to FIG. 14A. The same routine is continually re-executed upon receipt of successive pattern count pulses until the value at address, A1OFFCD has been decremented to 0 (FIG. 14A, Step D). At this point, the value stored in the COUNTCHK register of memory block D is incremented by 1 such that the COUNTCHK register now contains a value of 5, (FIG. 14A, Step G). The pointer X register is then loaded with address A2ONCDRUT at FIG. 14A, and program control jumps via return 1 (FIG. 14A, Step I) to return 1 from interrupt 1, (FIG. 13B, Step Q).

Figure 14B:
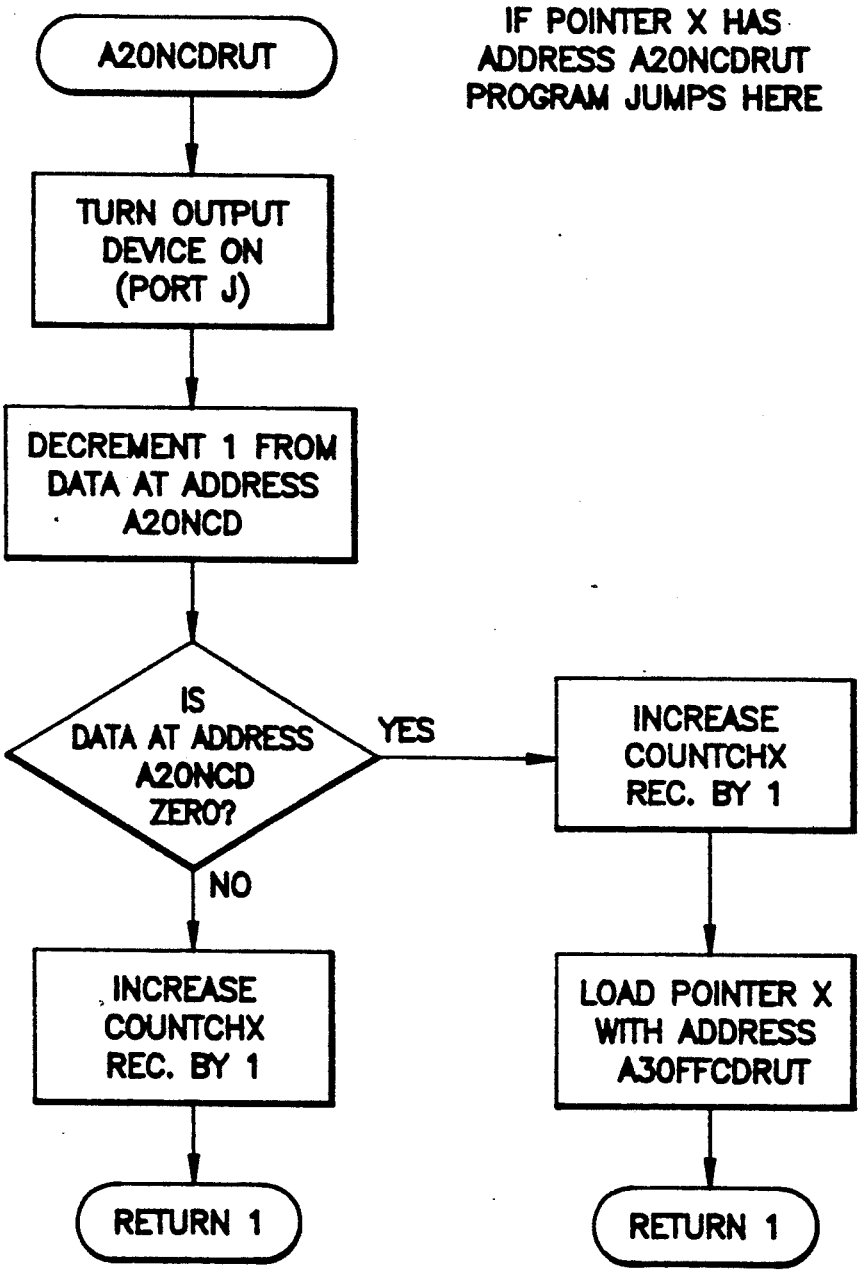

Upon receipt of the next pattern count pulse (in the example discussed this would be the sixth generated pattern count pulse), the microprocessor 33 executes interrupt 1 (FIG. 13B, Step P) and jumps to the new address in pointer X which is A2ONCDRUT (FIG. 14B, Step A). At FIG 14B, Step B, the output device is turned on (port J of microprocessor 33) the address at A2ONCD is decremented by 1 (FIG. 14B, Step C), the value of the A2ONCD register is checked for 0 at Step D, program control exits through NO at Step D, and the COUNTCHK register is incremented by 1 at Step E. Program control again returns through return 1 (FIG. 14B, Step F) to wait for the next pattern count pulse.

Figure 14C:
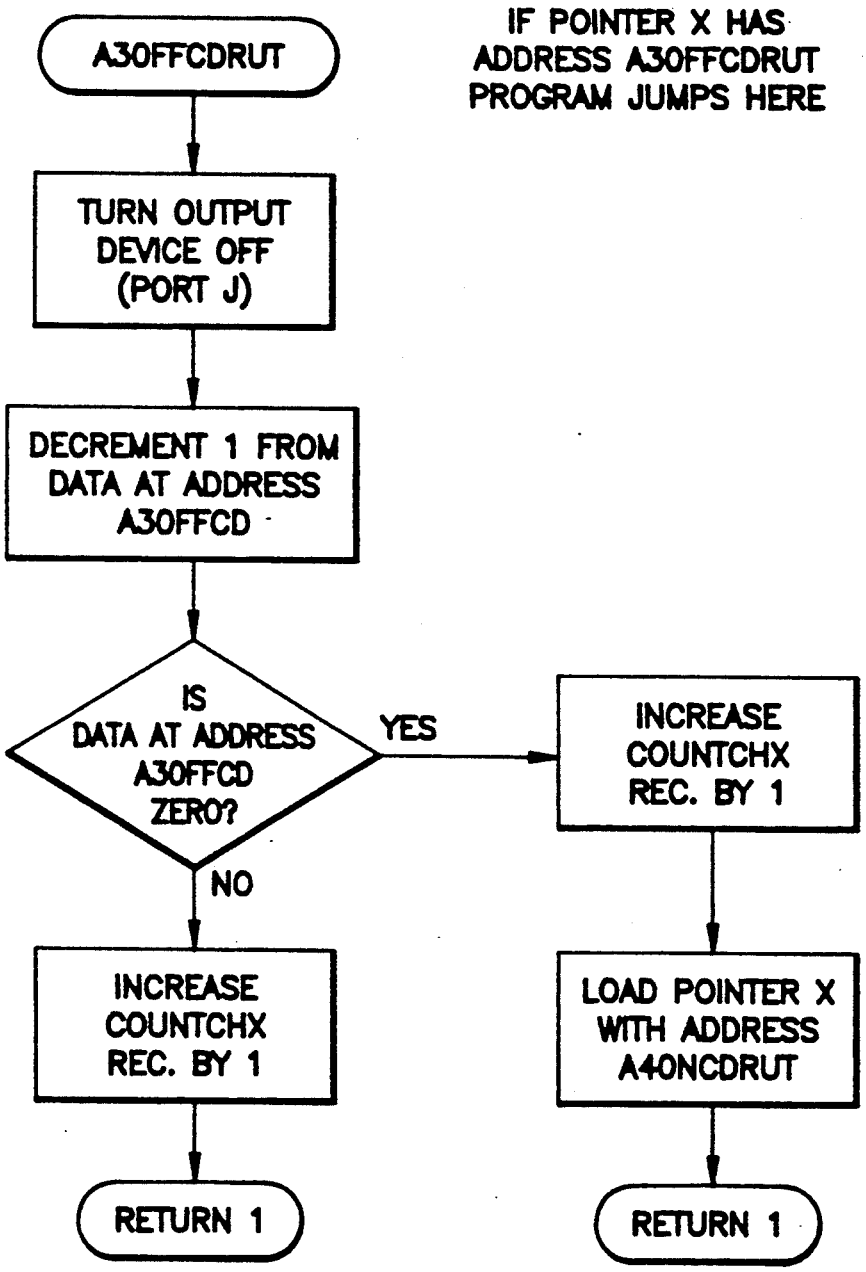
Figure 14D:
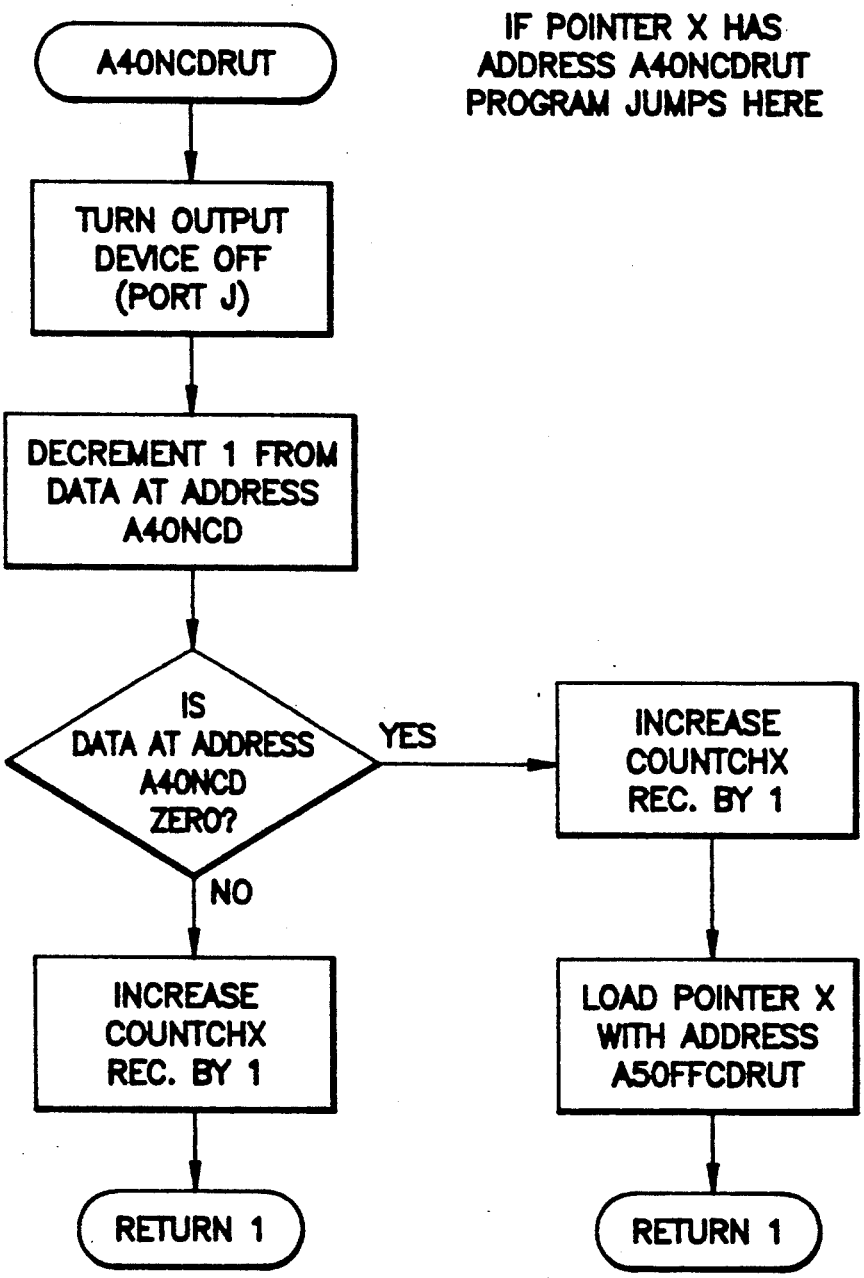
Figure 14E:
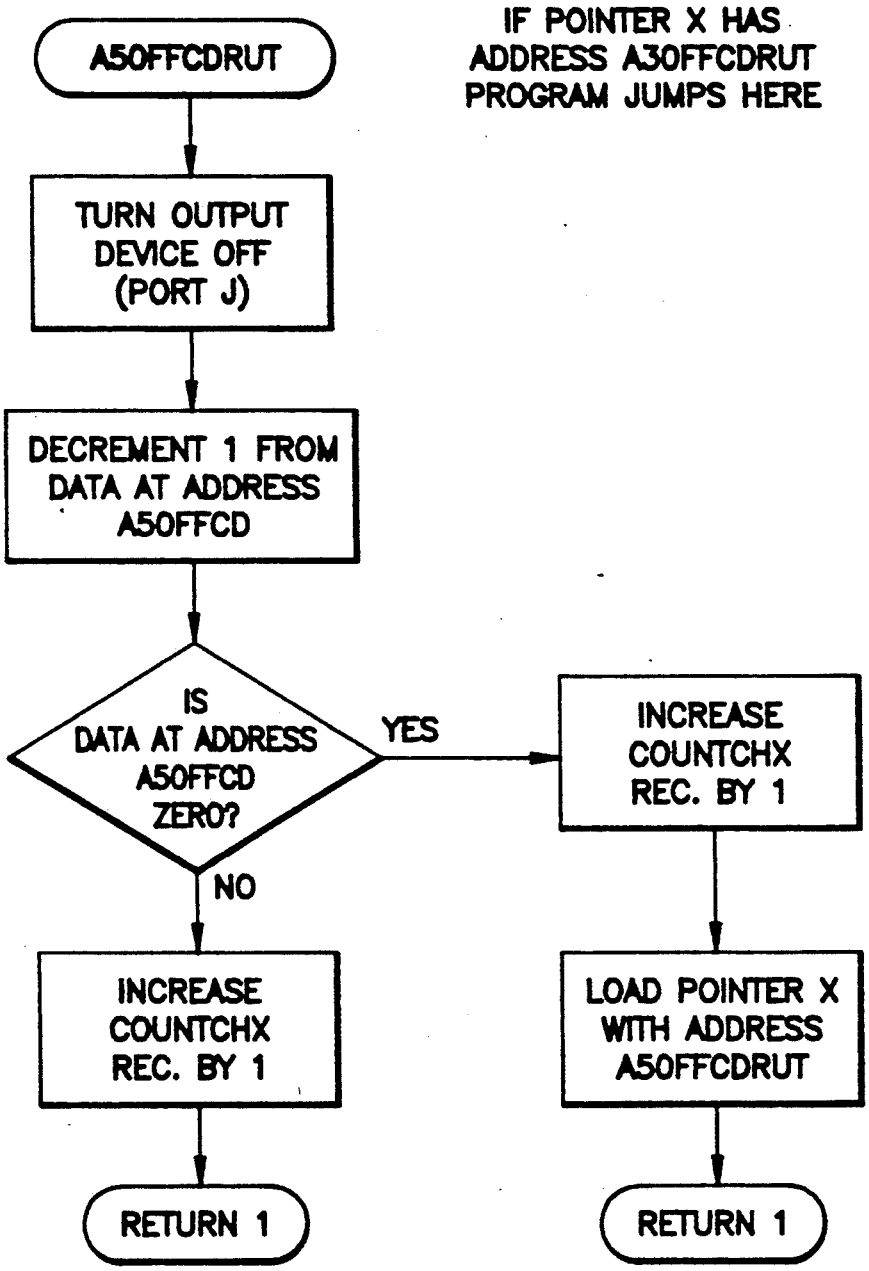

The identical procedure is followed with reference to FIGS. 14C, 14D and 14E for controlling application of the pattern to the object via port J and output device 49, in accordance with the example programmed pattern shown in FIG. 11.

Each time the program jumps to the flowcharts shown in FIGS. 14A–14E, the COUNTCHK register is increased by 1.

Upon detection of the trailing edge of the object by photo eye 23, program flow within microprocessor 33 jumps to interrupt 2, as shown in FIG. 13B, Step R.

Specifically, the contents of the COUNTCHK register (memory block D) are loaded into an internal accumulator of microprocessor 33, (FIG. 13B, Step S), and the value in the a is compared with the user defined size at memory block B (FIG. 11), as illustrated in Step T of FIG. 13B.

Normally, the computed values are identical (i.e. YES decision at FIG. 13B, Step T), in which case program flow returns to FIG. 13B, Step L, via Step U discussed in greater detail below. The microprocessor clears the COUNTCHK register and loads the pointer X with the address of the first pattern (A1OFFCDRUT) and the user defined pattern values are again copied from memory block A to memory block C (FIG. 13B, step M). Interrupts are enabled via ports L and E (FIG. 13B, Step N), and the system waits for detection of the leading edge of the next object (FIG. 13B, Step O).

However, in the event that the speed of operation (i.e. conveyor belt speed) changes, the value at port E (i.e. pattern count pulses) will not be the same as the designated user value at memory block B (FIG. 11). The microprocessor 33 detects the inequality as a result of the above-discussed comparison of the accumulator contents and the contents of memory block B, and measures the difference therebetween. In the event that the difference exceeds a predetermined threshold value, (e.g. ±02) (FIG. 13B, Step T) then program flow follows a "NO" decision at FIG. 13B, Step T, and the contents of the error register are incremented i.e. from 0 to 1) within the microprocessor 33 (FIG. 13B, Step V). The error register (E.R.) is then checked to see whether the value stored therein is greater than a further predetermined value (e.g. 2). If not, program control branches via a NO decision at Step W and returns to FIG. 13B, Step L).

On passing of the next two objects, the microprocessor 33 again compares the detected and user programmed input count values (i.e. object length), and in the event the difference again exceeds the aforementioned threshold value (e.g. a value of 2) upon passage of the second and third consecutive objects, then the value stored in the error register will have been incremented to greater than 2 (a YES decision at FIG. 13B, Step W) such that program control branches to restart (FIG. 13A, Step Y) for re-executing the set-up mode (i.e. via GO TO instruction at FIG. 13B, Step X). The output device 49 is disabled, the divider circuits 43 and 37 and the count storage circuit 35 are reset and the run mode gate 41 is disabled (FIG. 13A, Step Z).

On the other hand, in the event that there are fewer than three consecutive errors which exceed the aforementioned threshold value, the microprocessor 33 continues with the original setting.

In this way, the programmable pattern generator of the present invention effectively executes a control or feedback loop for detecting speed changes or changes in the length of successive travelling objects 15 and automatically corrects the pattern generation.

In addition to the circuitry discussed above, microprocessor 33 also includes a read only memory (ROM) 51 for storing the set-up mode and run mode program, and a random access memory (RAM) 53 for storing the user defined values. The RAM 53 is also provided with a battery back-up in a well known manner, for saving user defined values in the event of a power outage.

In summary, the method and apparatus of the present invention provides for creation and generation of a programmable pattern by simply measuring the size of an object, selecting the actual length of space or glue bead required, without any guess work or experiments with numbers. The user selects the actual pattern values which are measurements of the pattern required. Other embodiments and variations of the present invention are contemplated. For example, as an alternate to the two channel apparatus of the preferred embodiment, it is contemplated that a four or more channel apparatus may be provided.

Furthermore, the method and apparatus of the present invention may be used in various alternative applications. As an example, a code can be printed on the window of a package that is two inches away from the leading edge by simply programming the package size in column F to 80 for eight inches and programming a first OFF value at column A to twenty units (e.g. two inches), and programming an ON value at column B to 10 units for enabling the print head for one inch. This would result in energizing the print head at two inches away from the leading edge every time a package is detected by the photo eye and maintaining the print head energized for a duration of one inch length of the package.

All such embodiments and variations are believed to be within the sphere and scope of the present invention as defined in the claims appended hereto.

I claim:

1. A method for applying a programmable pattern to a succession of moving objects, comprising the steps of:

a) storing a user-defined length value representing the length of each of said objects;

b) storing further user defined pattern values representing said programmable pattern to be applied along said length;

c) generating a series of clock pulses;

d) entering a set-up mode, comprising the steps of:

i) detecting a leading and trailing edge of one of said succession of objects passing a fixed reference location and in response counting a number of said clock pulses between detection of said leading and trailing edges of said object; and ii) dividing said number by said user defined length value and in response generating and storing a first count value;

e) entering a run mode, comprising the steps of:

i) detecting leading and trailing edges of subsequent ones of said succession of objects passing said fixed reference location and in response successively counting further numbers of said clock pulses between detection of said leading and trailing edges of said succession of objects;

ii) successively dividing said further numbers of said clock pulses by said first count value and in response generating successive further count values; and iii) comparing successive ones of said further count values to said user defined length value and in the event said successive further count values are equal to said user defined length value applying said programmable pattern to said subsequent ones of said succession of objects at said fixed reference location, and in the event a predetermined number of said successive further count values are not equal to said user defined length value re-executing step d) such that said first count value is recalculated.

2. The method of claim 1, wherein said steps of applying said programmable pattern further comprises applying a glue bead to said subsequent ones of said succession of objects.

3. The method of claim 1, wherein said step of applying said programmable pattern further comprises applying an inkjet to said subsequent ones of said succession of objects.

4. Apparatus of applying a programmable pattern to a succession of moving objects, comprising:

a) means for storing a user defined length value representing the length of each of said objects;

means for storing further user defined pattern values representing said programmable pattern to be applied along said length;

c) means for generating a series of clock pulses;

d) set-up mode circuitry for detecting a leading and trailing edge of one of said succession of objects passing a fixed reference location and in response counting a number of said clock pulses between detection of said leading and trailing edges of said object;

e) means for dividing said number by said user defined length value and in response generating and storing a first count value;

f) run mode circuitry for detecting leading and trailing edges of subsequent ones of said succession of objects passing said fixed reference location and in response disabling said set-up mode circuitry and successively counting further numbers of said clock pulses between detection of said leading and trailing edges of said succession of objects;

g) means for successively dividing said further numbers of said clock pulses by said first count value and in response generating successive further count values; and h) means for comparing successive ones of said further count values to said user defined length value and in the event said successive further count values are equal to said user defined length value applying said programmable pattern to said subsequent ones of said succession of objects at said fixed reference location, and in the event a predetermined number of said successive further count values are not equal to said user defined length value disabling said run mode circuitry and enabling said set-up mode circuitry such that said first count value is recalculated.

5. Apparatus as defined in claim 4, wherein said means for storing said user defined length value comprises a user input keyboard for receiving said user defined length value, and a microprocessor for storing said received user defined length value in a predetermined memory location of said microprocessor.

6. Apparatus as defined in claim 4, wherein said means for storing further user defined pattern values comprises a user input keyboard for receiving said further user defined pattern values, and a microprocessor for storing said received further user defined pattern values in predetermined successive memory locations of said microprocessor.

7. Apparatus as defined in claim 4, wherein said means for generating comprises a clock circuit.

8. Apparatus as defined in claim 7, further comprising:

a) a photo eye disposed at said fixed reference location for detecting said succession of moving objects and in response generating a succession of enable signals;

b) a set-up mode gate for receiving a first one of said enable signals and in response transmitting said clock pulses while said first one of said objects is moving past said photo eye; and c) a run mode gate for receiving successive further enable signals and in response further transmitting said clock pulses while said subsequent objects move past said photo eye.

9. Apparatus of claim 8, wherein said means for dividing further comprises:

a) a first divider circuit for receiving said clock pulses from said set-up mode gate and said user defined length value from said means for storing said user defined length value, and in response generating said first count value; and b) a store counter for receiving and storing said first count value.

10. Apparatus as defined in claim 9, wherein said means for successively dividing further comprises a second divider circuit for receiving said clock pulses from said run mode gate and receiving said first count value from said store counter, and in response generating said successive further count values.

11. Apparatus as defined in claim 10, wherein said means for comparing further comprises a microprocessor executing a predetermined program.

12. Apparatus as defined in claim 4, further comprising an output device positioned at said first reference location for applying said programmable pattern to said subsequent ones of said succession of objects.

13. Apparatus as defined in claim 12, wherein said output device further comprises a glue applicator.

14. Apparatus as defined in claim 12, wherein said output device further comprises an inkjet.

15. Apparatus as defined in claim 4, further comprising means for displaying said user defined length value representing the length of said pattern and said further user defined pattern values representing said programmable pattern.

16. Apparatus as defined in claim 15, wherein said means for displaying comprises a display screen.

17. The method of claim 1, wherein said predetermined number of said successive further count values is two.

18. Apparatus as defined in claim 4, wherein said predetermined number of said successive further count values is two.

* * * * *

UNITED STATES PATENT AND TRADEMARK OFFICE

CERTIFICATE OF CORRECTION

PATENT NO. : 5,217,745

DATED : 8 June 1993

INVENTOR(S) : Patel

It is certified that error appears in the above-identified patent and that said Letters Patent is hereby corrected as shown below:

In column 2, line 20, delete "he" and insert --the--.

In column 2, line 36, delete "int eh" and insert --in the--.

In column 2, line 44, delete "describe din" and insert --described in--.

In column 6, line 48, insert --of-- after the word "presence".

In column 7, line 4, delete "(FIG. 13B)" and insert --(FIG. 13B Step I)--.

In column 7, line 68, delete "FIG. 14A," and insert --FIG. 14A, Step H,--.

In column 8, line 31, delete the word "a" and insert --accumulator--.

UNITED STATES PATENT AND TRADEMARK OFFICE

CERTIFICATE OF CORRECTION

PATENT NO. : 5,217,745

DATED : 8 June 1993

INVENTOR(S) : Patel

It is certified that error appears in the above-indentified patent and that said Letters Patent is hereby corrected as shown below:

In column 10, line 40, indent and insert --b)-- before the word "means".

Signed and Sealed this

Twenty-ninth Day of March, 1994

Bruce Lehman

*Attest:*

BRUCE LEHMAN

*Attesting Officer*

*Commissioner of Patents and Trademarks*